US011198294B2

(12) United States Patent
Fukada

(10) Patent No.: US 11,198,294 B2
(45) Date of Patent: Dec. 14, 2021

(54) INKJET HEAD, INKJET COATING DEVICE, AND INKJET COATING METHOD

(71) Applicant: Panasonic Intellectual Property Management Co., Ltd., Osaka (JP)

(72) Inventor: Kazuki Fukada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 11 days.

(21) Appl. No.: 16/683,896

(22) Filed: Nov. 14, 2019

(65) Prior Publication Data

US 2020/0180313 A1 Jun. 11, 2020

(30) Foreign Application Priority Data

Dec. 5, 2018 (JP) ..... JP2018-228002

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2/14209; B41J 2002/14241; B41J 2/14233; B41J 2/14274; B41J 2/14282; B41J 2/1429; B41J 2/14298; B41J 2002/14217; B41J 2002/14225; B41J 2002/1425; B41J 2002/14266; B41J 2002/14306
See application file for complete search history.

(56) References Cited

U.S. PATENT DOCUMENTS

| | | | | |
|---|---|---|---|---|
| 2005/0099452 | A1 | 5/2005 | Kusunoki | |
| 2008/0238980 | A1 | 10/2008 | Nagashima et al. | |
| 2012/0089090 | A1 | 4/2012 | Karasawa | |
| 2012/0182352 | A1 | 7/2012 | Fukada et al. | |
| 2018/0170066 | A1* | 6/2018 | Ohtsu | B41J 2/18 |

FOREIGN PATENT DOCUMENTS

| | | |
|---|---|---|
| JP | 2004-195959 | 7/2004 |
| JP | 2008-254196 | 10/2008 |
| JP | 2012-011653 | 1/2012 |
| JP | 2012-095999 | 5/2012 |
| JP | 2012-158170 | 8/2012 |

* cited by examiner

*Primary Examiner* — Kristal Feggins
(74) *Attorney, Agent, or Firm* — Wenderoth, Lind & Ponack L.L.P.

(57) ABSTRACT

An inkjet head or the like that is capable of efficiently applying a pressure required for discharging a liquid material includes: a nozzle hole; a pressure chamber; a liquid material supply flow path; a liquid material recovery flow path; a diaphragm; a piezoelectric element; and orifice structures that are respectively disposed between the liquid material supply flow path and the pressure chamber, and between the liquid material recovery flow path and the pressure chamber, and that are narrower than the pressure chamber in a plan view as viewed from a discharge direction of the liquid material.

10 Claims, 9 Drawing Sheets

INKJET HEAD, INKJET COATING DEVICE, AND INKJET COATING METHOD

TECHNICAL FIELD

The technical field relates to an inkjet head, an inkjet coating device, and an inkjet coating method.

BACKGROUND

An inkjet head is known as a liquid discharge head that is capable of coating a coating target with a liquid material in a required amount at an arbitrary timing in accordance with an input signal. For example, as disclosed in JP-A-2012-11653 (Patent Literature 1), an inkjet head has been applied to various applications such as a wiring pattern of an electronic circuit and a device of manufacturing various devices.

SUMMARY

Meanwhile, as one of the applications in which the inkjet head is used, there is an application in which a liquid material having a high viscosity is discharged. In the application of discharging such a liquid material having a high viscosity, it is important to efficiently apply a pressure required for discharge.

Therefore, the disclosure concerns an inkjet head or the like that is capable of efficiently applying a pressure required for discharging a liquid material.

In order to achieve the above object, aspects of an inkjet head, an inkjet coating device, and an inkjet coating method of the disclosure have the following features.

[1. Inkjet Head]

The inkjet head includes: a nozzle hole through which a liquid material is discharged; a pressure chamber that communicates with the nozzle hole; a supply flow path that communicates with the pressure chamber and through which the liquid material is supplied to the pressure chamber; a recovery flow path that communicates with the pressure chamber and through which the liquid material is recovered from the pressure chamber; a diaphragm that reciprocally vibrates with respect to the liquid material supplied into the pressure chamber; an actuator that provides a displacement for vibrating the diaphragm; and orifice structures that are respectively disposed between the supply flow path and the pressure chamber, and between the recovery flow path and the pressure chamber, and that are narrower than the pressure chamber in a plan view as viewed from a discharge direction of the liquid material.

[2. Inkjet Coating Device]

The inkjet coating device includes: the inkjet head; a liquid material supply unit that supplies the liquid material to the inkjet head; and a control unit that generates an electrical signal for driving the actuator, and controls an operation of discharging the liquid material by the inkjet head; and a transport unit that moves the inkjet head and a coating target relative to each other.

[3. Inkjet Coating Method]

The inkjet coating method includes: a generating step of generating a pressure wave by reducing a volume of a pressure chamber in which a liquid material supplied from a supply flow path is accommodated; and a discharging step of discharging the liquid material from a nozzle hole, by reflecting the generated pressure wave in a direction of the nozzle hole through a pressure wave reflection wall provided in the pressure chamber and through orifice structures that are respectively disposed between the supply flow path and the pressure chamber and between a recovery flow path and the pressure chamber.

According to the aspects of the disclosure, there is provided an inkjet head or the like that is capable of efficiently applying a pressure required for discharging a liquid material.

DESCRIPTION OF EMBODIMENTS (Knowledge as Basis of Disclosure) Among inkjet heads, a piezoelectric (piezo) inkjet head in particular is currently being actively developed because the piezoelectric inkjet head can perform coating with a wide variety of liquid materials while controlling the liquid materials with high accuracy.

In general, the piezoelectric inkjet head includes: a supply flow path for a liquid material; a pressure chamber that communicates with the supply flow path and includes a nozzle hole; and a piezoelectric element that applies a pressure via a diaphragm to the liquid material filled in the pressure chamber.

Further, by applying a drive voltage to the piezoelectric element, a mechanical distortion is generated in the piezoelectric element and the diaphragm, and accordingly a pressure is applied to the liquid material facing the diaphragm in the pressure chamber, to have the liquid material discharged from the nozzle hole.

Figure 1:
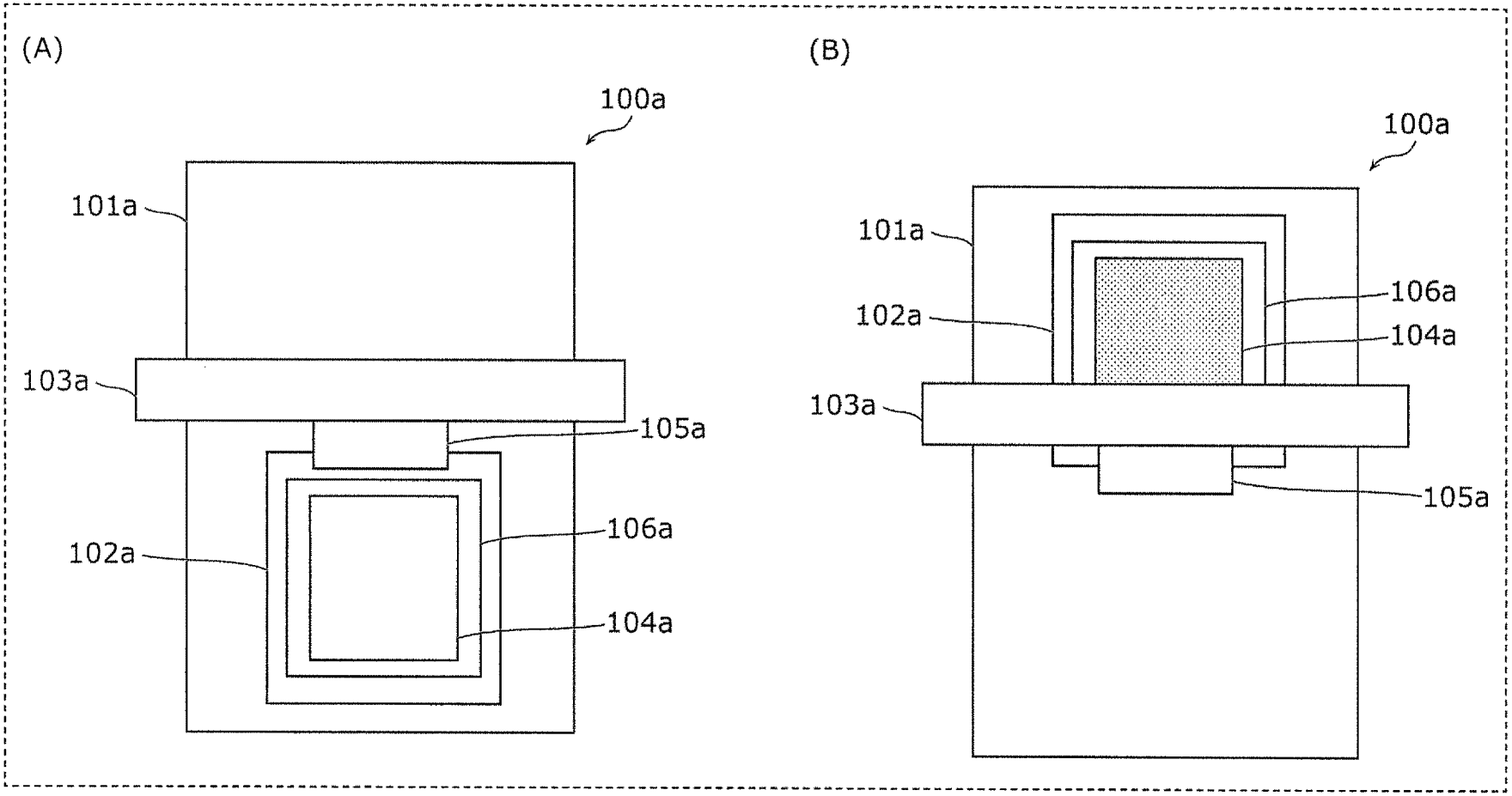
FIG. 1 RELATED ART
FIG. 1 is an overview diagram of an inkjet coating device in the related art.

An inkjet coating device including such a general inkjet head will be described with reference to FIG. 1. FIG. 1 is a plan view of a general inkjet coating device 100*a*. (A) of FIG. 1 illustrates a state before a coating area 104*a* of a substrate 106*a* (coating target) is coated with a liquid material by the inkjet coating device 100*a*. (B) of FIG. 1 illustrates a state after the coating area 104*a* of the substrate 106*a* is coated with the liquid material by the inkjet coating device 100*a*.

As shown in FIG. 1, the inkjet coating device 100*a* includes a stand 101*a*, a substrate transport stage 102*a* disposed on the stand 101*a*, and an inkjet head 105*a* facing the substrate transport stage 102*a*. In addition, the inkjet head 105*a* is disposed on a gantry 103*a* straddling the substrate transport stage 102*a*.

Figure 2:
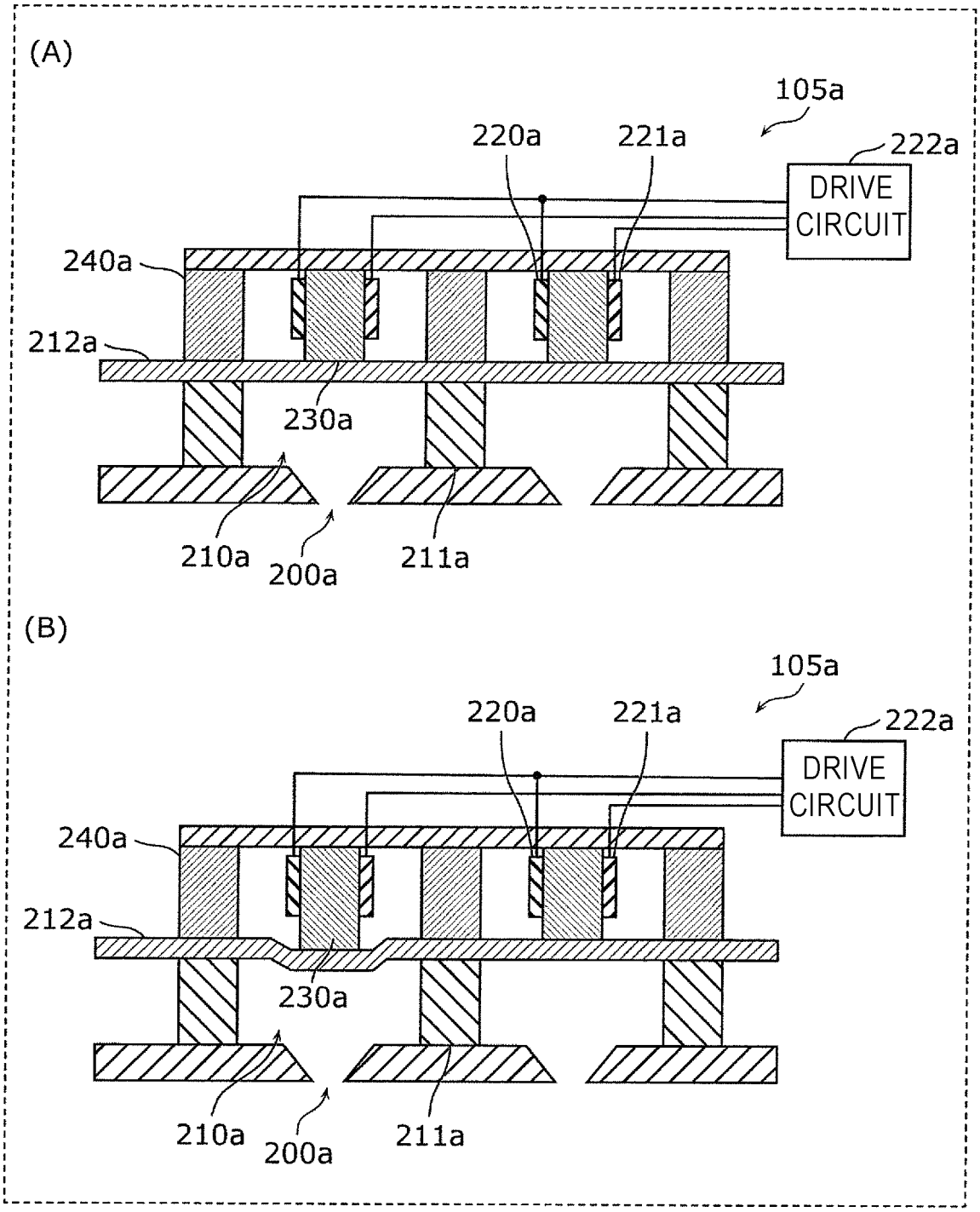
FIG. 2 RELATED ART
FIG. 2 is a cross-sectional view illustrating a basic structure of the inkjet head in the related art.

Further, the inkjet head 105*a* will be described with reference to FIG. 2. FIG. 2 is a cross-sectional view illustrating a basic structure of the general inkjet head 105*a*. (A) of FIG. 2 illustrates a cross section of the inkjet head 105*a* when a pressure chamber 210*a* is not pressurized. (B) of FIG. 2 illustrates a cross section of the inkjet head 105*a* when the pressure chamber 210*a* is pressurized.

As shown in FIG. 2, the inkjet head 105*a* includes: a plurality of nozzle holes 200*a* through which the liquid material is discharged; the pressure chambers 210*a* that communicate with the nozzle holes 200*a*; pressure walls 211*a* that separate the pressure chambers 210*a*; diaphragms 212*a*, each of which forms a part of an outer wall of the respective pressure chambers 210*a*; piezoelectric elements 230*a* that cause the diaphragms 212*a* to vibrate; piezoelectric elements 240*a* that support the pressure walls 211*a*; common electrodes 220*a* and individual electrodes 221*a* that apply a drive voltage to the piezoelectric elements 230*a*; and a drive circuit 222*a* that is connected to the common electrodes 220*a* and the individual electrodes 221*a*. The inkjet head 105*a* additionally includes an introduction port (not shown) for the liquid material.

The inkjet head 105*a* configured as described above operates as follows. When a drive voltage is applied between the common electrode 220*a* and the individual electrode 221*a*, the piezoelectric element 230*a* is deformed from the state shown in (A) of FIG. 2 to a state shown in (B) of FIG. 2. When the piezoelectric element 230*a* is deformed, the volume of the pressure chamber 210*a* is reduced, and a pressure is applied to the liquid material in the pressure chamber 210*a*. The liquid material is discharged from the nozzle hole 200*a* due to this pressure.

Returning to FIG. 1, a coating operation of the inkjet coating device 100*a* will be described below. The substrate transport stage 102*a* is moved, thereby changing from the state shown in (A) of FIG. 1 to the state shown in (B) of FIG. 1. At this time, the liquid material is discharged from the inkjet head 105*a* toward the substrate 106*a* placed on the substrate transport stage 102*a*, and the predetermined coating area 104*a* of the substrate 106*a* is coated with the liquid material (dot hatching is given in (B) of FIG. 1). A moving speed of the substrate transport stage 102*a* can be 10 mm/s to 400 mm/s. A discharge frequency of an ink used as the liquid material can be 100 Hz to 50,000 Hz. The inkjet coating device 100*a* forms an arbitrary pattern in the coating area 104*a*, by detecting a position of the substrate transport stage 102*a* and controlling a discharge timing of the liquid material.

In recent years, application development toward industrial applications is expected in various fields, in addition to printers for photographic printing in consumer applications, taking advantage of an inkjet system in which such an arbitrary pattern can be printed on demand.

In particular, coating has been performed by mask printing such as screen printing or with a single nozzle dispenser so far, and there has been an increasing demand to perform coating in an inkjet manner with a liquid material having a high viscosity and containing functional particles, such as an imprint paste, a phosphor paste, and an adhesive, in addition to a solder paste and a silver paste.

However, with respect to inkjet heads in the related art which are disclosed in JP-A-2012-11653 (Patent Literature 1) and JP-A-2004-195959 (Patent Literature 2), in order to fill the pressure chamber with a liquid material having a high viscosity, it is necessary to reduce a pressure loss of the supply flow path. Further, in order to discharge the liquid material having a high viscosity from the nozzle hole, it is necessary to increase the pressure loss of the supply flow path to a predetermined level or higher such that the pressure in the pressure chamber does not leak to the supply flow path, while there is a limit on a mechanism in the related art to satisfy both the filling of the liquid material having a high viscosity into the pressure chamber and the discharge of the liquid material having a high viscosity from the nozzle hole. Therefore, there is a problem in the mechanism in the related art that the liquid material having a high viscosity cannot be discharged from the nozzle hole, and there is room for improvement.

Accordingly, an object of the disclosure is to provide an inkjet head or the like that is capable of discharging even a liquid material having a high viscosity. An inkjet head according to an embodiment of the disclosure includes: a nozzle hole through which a liquid material is discharged; a pressure chamber that communicates with the nozzle hole; a flow path that communicates with the pressure chamber and through which the liquid material is supplied to the pressure chamber; a recovery flow path that communicates with the pressure chamber and through which the liquid material is recovered from the pressure chamber; a diaphragm that reciprocally vibrates with respect to the liquid material supplied into the pressure chamber; an actuator that provides a displacement for vibrating the diaphragm; and orifice structures that are respectively disposed between the supply flow path and the pressure chamber, and between the recovery flow path and the pressure chamber, and that are narrower than the pressure chamber in a plan view as viewed from a discharge direction of the liquid material.

Accordingly, there is provided an inkjet head that is applicable to industrial applications such as manufacturing of electronic devices, and that handles a liquid material having a high viscosity and containing functional particles, such as an imprint paste, a phosphor paste, and an adhesive, in addition to a solder paste and a silver paste.

Therefore, according to a configuration of the disclosure, there is provided an inkjet coating device or the like that is capable of controlling coating with a liquid material, having a high viscosity and containing functional particles, at a high speed and in a stable manner, and that is capable of coating a desired location with an optimum amount of the liquid material in an arbitrary pattern, in industrial applications such as manufacturing of electronic devices.

Hereinafter, embodiments of the disclosure will be described with reference to the drawings. It should be noted that all of the embodiments described below show inclusive or specific examples. Numerical values, shapes, materials, constituent elements, arrangement positions and connection forms of the constituent elements, steps, order of the steps, and the like shown in the following embodiments are merely examples, and are not intended to limit the disclosure. In addition, among the constituent elements in the following embodiments, constituent elements not recited in independent claims are described as arbitrary constituent elements.

The drawings used for illustration are schematic views and are not necessarily strictly illustrated. In the drawings, the same components are substantially denoted by the same reference numerals, and a repetitive description thereof may be omitted or simplified.

In the drawings, a direction in which the ink is discharged is a Z-axis direction, and particularly a traveling direction of the discharged ink is described as a Z-axis minus direction (downward direction). Further, a plane perpendicular to the Z-axis is an XY plane that is defined by an X-axis and a Y-axis orthogonal to each other, and in particular, a direction in which a plurality of nozzle holes of the inkjet head are arranged is defined as the X-axis, which will be described below.

Embodiment

<Inkjet Head>

Figure 3:
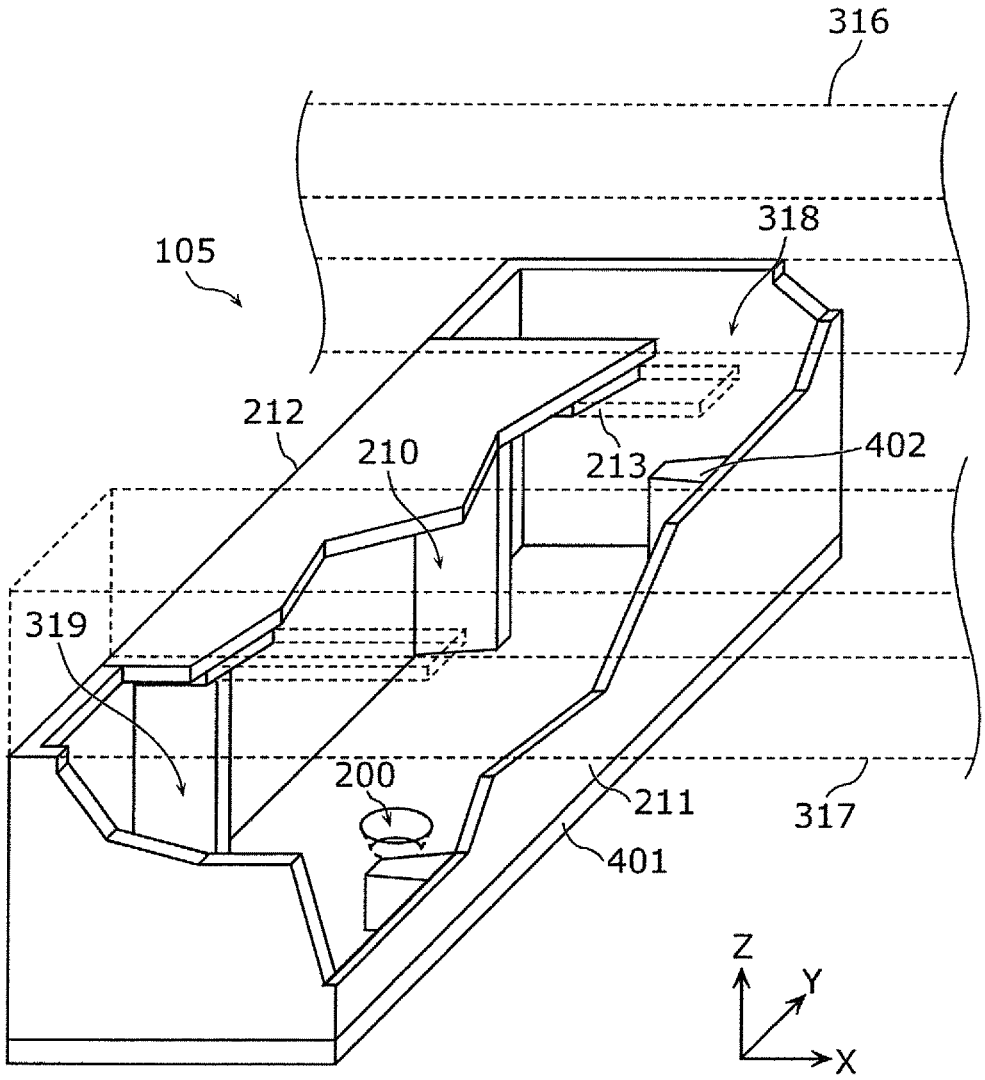
FIG. 3 is a perspective view illustrating an entire discharge flow path of an inkjet head according to an embodiment.

First, an inkjet head according to an embodiment will be described with reference to FIGS. 3 to 5. FIG. 3 is a perspective view illustrating an entire discharge flow path of a liquid material provided for each nozzle hole 200, in an inkjet head 105 provided in an inkjet coating device 100 according to the present embodiment.

The discharge flow path of the inkjet head 105 shown in FIG. 3 is illustrated in a state where a part on a plus side of the X-axis, the Y-axis, and the Z-axis in the drawing is broken and an inside of the discharge flow path is exposed. A liquid material common supply flow path 316 and a liquid material common recovery flow path 317, which will be described below, are flow paths having a rectangular cross section, and outlines thereof are indicated by broken lines in a transparent manner. Further, end portions of the liquid material common supply flow path 316 and the liquid material common recovery flow path 317 in an X-axis direction are not shown. A part of a pressure wave reflection wall 213 to be described below is indicated by a solid line with a broken part as a boundary, and the other part is indicated by a broken line in a transparent manner.

The inkjet head 105 in the present embodiment includes a nozzle plate 401 in which the nozzle hole 200 is formed, a pressure wall 211, a diaphragm 212, an actuator (not shown), the pressure wave reflection wall 213, and an orifice structure 402. Further, since the inkjet head 105 includes a plurality of the discharge flow paths shown in FIG. 3, the liquid material can be discharged from a plurality of the nozzle holes 200.

More specifically, in the inkjet head 105, the discharge flow path shown in FIG. 3 is disposed in plurality along the X-axis direction, and the liquid material common supply flow path 316 is provided so as to connect supply ports of the liquid material in the plurality of discharge flow paths. Similarly, the liquid material common recovery flow path 317 is provided so as to connect recovery ports of the liquid material in the plurality of discharge flow paths. With such a liquid material common supply flow path 316, the liquid material is supplied to the discharge flow paths, and the inkjet head 105 can discharge the liquid material from the plurality of nozzle holes 200. Further, with such a liquid material common recovery flow path 317, the inkjet head 105 can discharge the liquid material from the plurality of nozzle holes 200 while circulating the liquid material in the discharge flow paths.

Figure 4:
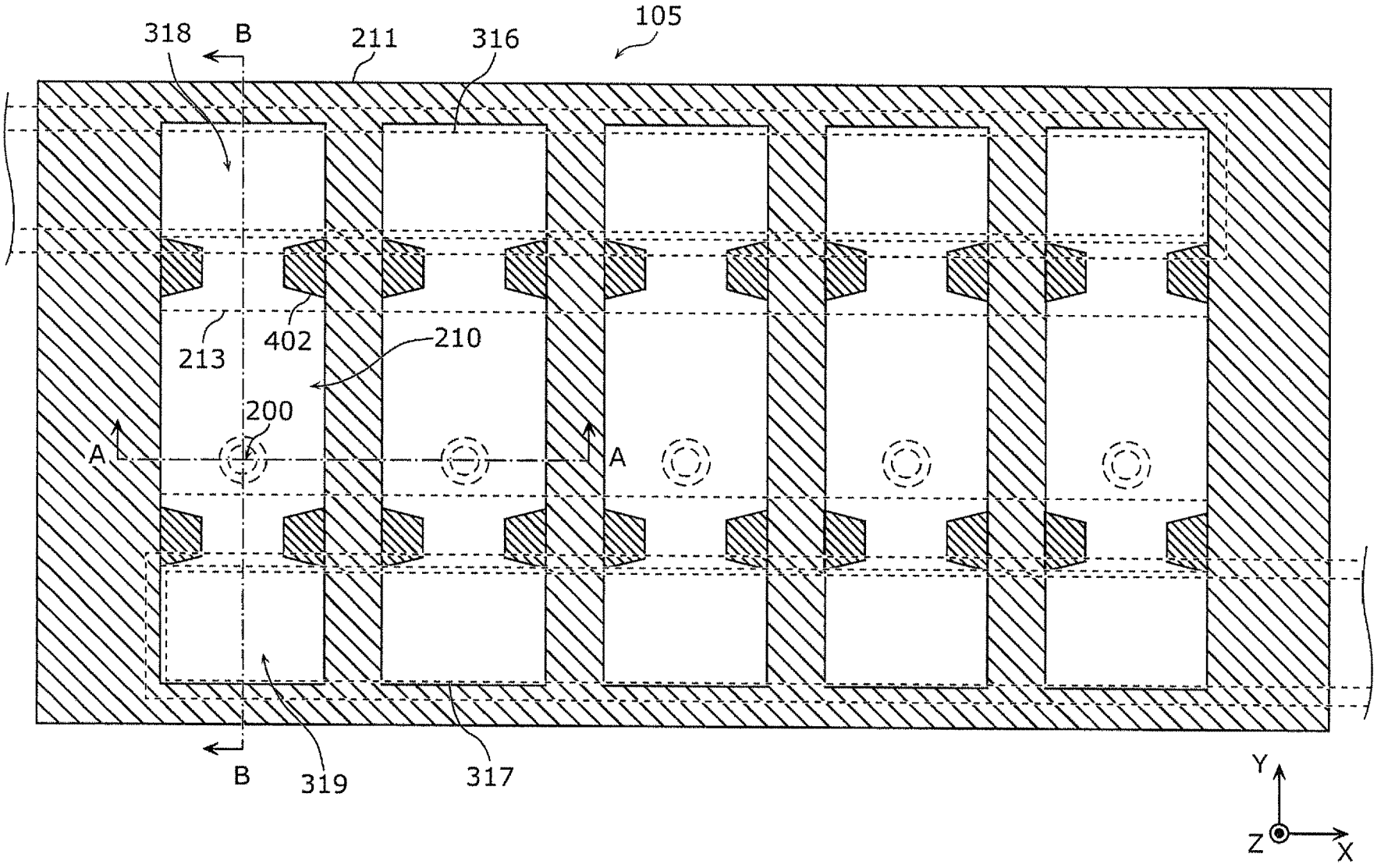
FIG. 4 is a cross-sectional view of a pressure chamber when the inkjet head according to the embodiment is viewed from an axial direction of a nozzle hole.

FIG. 4 is a cross-sectional view of a pressure chamber when the inkjet head 105 is viewed from an axial direction (Z-axis direction) of the nozzle hole 200. FIG. 4 shows a cross-sectional view of the inkjet head 105 as viewed from a Z-axis plus direction. Although not shown on the same cross section, the nozzle hole 200, the pressure wave reflection wall 213, the liquid material common supply flow path 316, and the liquid material common recovery flow path 317 are indicated by broken lines in a transparent manner.

The inkjet head 105 includes the liquid material common supply flow path 316 and the liquid material common recovery flow path 317 extending along the X-axis direction, and a plurality of discharge flow paths connecting the liquid material common supply flow path 316 and the liquid material common recovery flow path 317. The plurality of discharge flow paths are, for example, rectangular spaces defined by the pressure wall 211, the nozzle plate 401, and the diaphragm 212.

Each of the plurality of discharge flow paths is further divided into a pressure chamber 210, a liquid material supply flow path 318 (an example of a supply flow path), and a liquid material recovery flow path 319 (an example of a recovery flow path). Although the pressure chamber 210, the liquid material supply flow path 318, and the liquid material recovery flow path 319 are separated by the orifice structure 402, since the orifice structure is formed with an opening such that each of the separated sections communicates with each other, the pressure chamber 210 and the liquid material supply flow path 318 allow the liquid material to flow therethrough. Similarly, the pressure chamber 210 and the liquid material recovery flow path 319 are separated by the orifice structure 402 and allow the liquid material to flow therethrough. Therefore, the liquid material supplied to the liquid material supply flow path 318 is supplied to the pressure chamber 210 in communication therewith, and is further recovered to the liquid material recovery flow path 319 in communication therewith.

Each of the discharge flow paths of the inkjet head 105 includes the nozzle hole 200 that communicates the pressure chamber 210 with an outside of the inkjet head 105, and the liquid material is discharged from the nozzle hole 200. Therefore, the liquid material supplied to the liquid material supply flow path 318 is supplied to the pressure chamber, which communicates with the nozzle hole and the liquid material recovery flow path 319, and then divided into the liquid material discharged from the nozzle hole 200 and the liquid material recovered to the liquid material recovery flow path 319.

Figure 5:
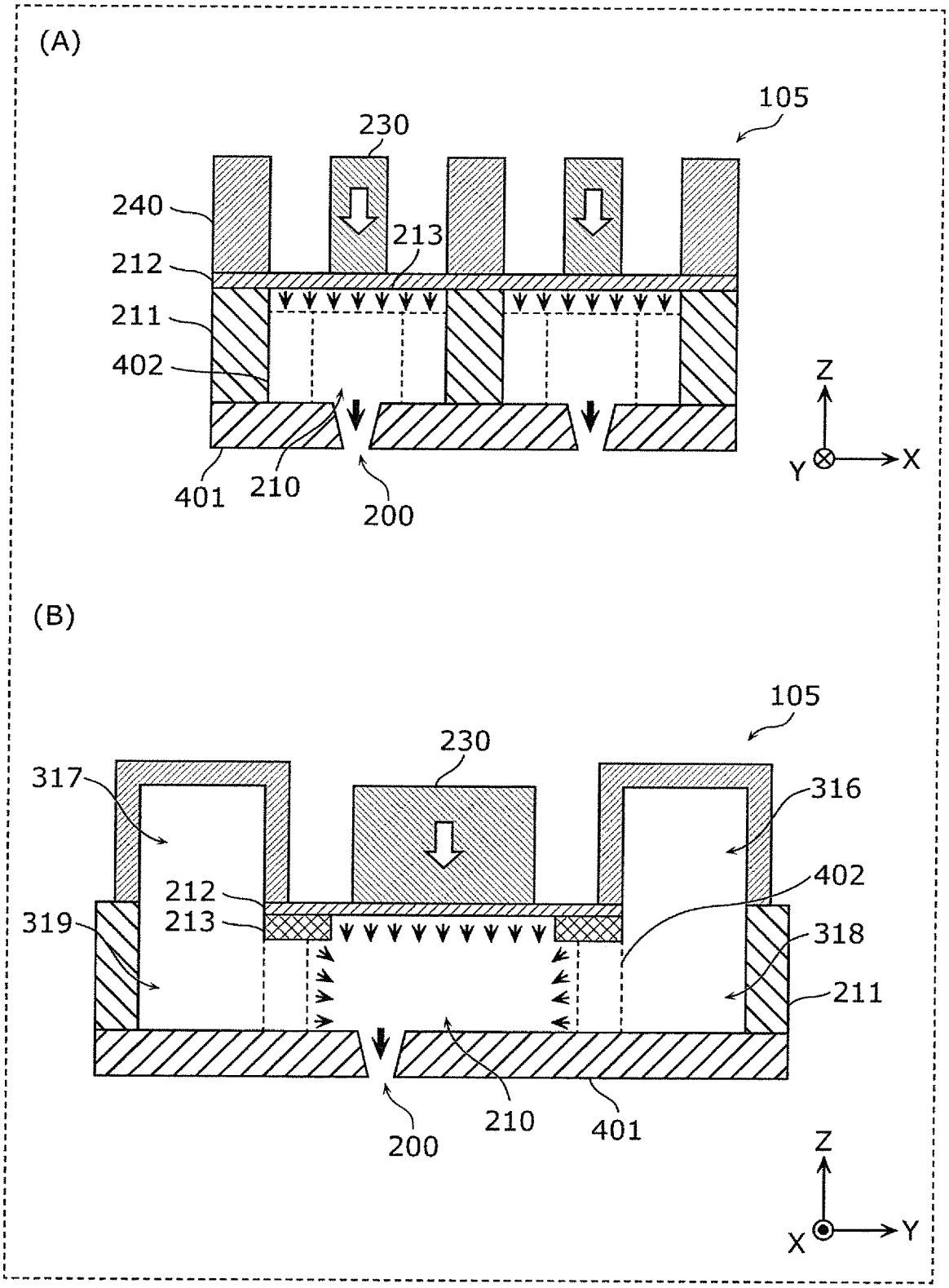
FIG. 5 is a cross-sectional view of a cut section passing through a center of the nozzle hole of the inkjet head according to the embodiment.

FIG. 5 is a cross-sectional view of a cut section passing through a center of the nozzle hole 200 of the inkjet head 105. (A) of FIG. 5 illustrates a cut section cut along a line A-A in FIG. 4. Further, (B) of FIG. 5 illustrates a cut section cut along a line B-B in FIG. 4. Similar to FIG. 4, although not shown on the same cross section, the pressure wave reflection wall 213 and the orifice structure 402 are indicated by broken lines in a transparent manner.

As described above, the pressure chamber 210 is configured with the nozzle plate 401, the pressure wall 211, the diaphragm 212, and the orifice structure 402. The discharge flow path is defined by the pressure wall 211, which includes the nozzle hole 200 and rises from the nozzle plate 401 disposed parallel to the XY plane (and extends in the Z-axis plus direction), and by the diaphragm 212, which is disposed parallel to the XY plane and on an end surface on an upper side (a Z-axis plus direction side) of the pressure wall 211. Further, the discharge flow path is divided by the orifice structures 402 disposed at two positions along a flow direction of the liquid material so as to be narrowed, and the pressure chamber 210 is thus formed. Piezoelectric elements 230 are disposed on an upper side of the pressure chamber 210 via the diaphragm 212. In addition, piezoelectric elements 240 are disposed on an upper side of the pressure wall 211 via the diaphragm 212. That is, the piezoelectric elements 230 and the piezoelectric elements 240 are alternately disposed on the diaphragm 212 along the X-axis direction.

Hereinafter, the features of the constituent elements of the inkjet head 105 will be described in detail.

<Actuator (Piezoelectric Element 230)>

The actuator is used as a drive source that provides a displacement for vibrating the diaphragm 212. In the embodiment, the actuator is configured using the piezoelectric element 230 in which an internal electrode and a piezoelectric body such as lead zirconate titanate are repeatedly stacked. The actuator is not limited to the actuator configured using the piezoelectric element 230, and alternatively may be, for example, an electrostatic actuator or a magnetostrictive actuator.

When a drive voltage is applied to the piezoelectric element 230 used in the embodiment, a change occurs in the piezoelectric element 230. At this time, when a pulsed drive voltage is applied, the piezoelectric element 230 repeats shifting between a displaced state and an original state, and vibrates the diaphragm 212 on which the piezoelectric element 230 is disposed.

<Diaphragm 212>

The diaphragm 212 constituting a part of the pressure chamber 210 faces the pressure chamber 210 and is in contact with the liquid material supplied into the pressure chamber 210. Further, the diaphragm 212 in the present embodiment is integrally formed with respect to the plurality of discharge flow paths, and alternatively the diaphragm 212 may be configured separately in each of the plurality of discharge flow paths. The diaphragm 212 has a function of transmitting electric energy used for driving (displacement) of the piezoelectric element 230, which is the actuator described above, as mechanical energy (vibration) necessary for discharging the liquid material.

Specifically, the diaphragm 212 receives the displacement of the piezoelectric element 230 and reciprocally vibrates with respect to the liquid material supplied into the pressure chamber 210, to generate a pressure wave in the liquid material. That is, a pressure is applied to the liquid material in the pressure chamber 210 due to the vibration of the diaphragm. 212, and such a pressure propagates as a pressure wave in the liquid material. Further, the pressure wave propagating in the liquid material reaches the liquid material filling the nozzle hole 200 and causes the liquid material to be discharged from the nozzle hole 200.

The diaphragm 212 may be made of a metal material including, for example, stainless steel, nickel, cobalt and palladium, or may be made of a resin material such as silicon resin, ceramic resin, polyether ether ketone (PEEK) or polyimide (PI). The diaphragm 212 may be made of any material as long as the diaphragm 212 has a material and structure that is not damaged by a discharge pressure (displacement of the piezoelectric element 230) when the liquid material is discharged or that is not eroded/eluted by the liquid material.

In addition, in order to perform coating with the liquid material with high accuracy, it is important that the diaphragm 212 can be driven at a high speed and that the diaphragm 212 has high responsiveness in response to a control input signal. For this purpose, it is preferable to select a material and structure that has a low rigidity. For example, an elastic modulus thereof is preferably selected from a range of 2 GPa to 200 GPa, and a thickness thereof is preferably selected from a range of 3 μm to 50

<Nozzle Plate 401>

The nozzle plate 401 may be made of a metal material including, for example, a cemented carbide alloy, stainless steel, nickel, cobalt, palladium, aluminum, and titanium, or may be made of a resin material such as silicon resin, ceramic resin, PEEK or PI. The nozzle plate 401 may be made of any material as long as the nozzle plate 401 has a material and structure that does not deteriorate due to abrasion with particles or the like contained in the liquid material when the liquid material is discharged or that is not eroded/eluted by the liquid material.

In addition, the nozzle hole 200 through which the liquid material is discharged is formed in the nozzle plate 401. A size (length in a radial direction) of the nozzle hole 200 to be formed is preferably selected from a range of, for example, 0.01 mm to 0.1 mm in accordance with a desired discharge droplet size, and a size and shape of the particles contained. The nozzle hole 200 is not limited to a round shape, and alternatively may be in any shape such as a polygonal shape including a square shape, a triangular shape, or a star shape.

Further, a length of the nozzle is preferably selected from a range of, for example, 0.01 mm to 0.5 mm in accordance with physical properties such as viscosity, thixotropy, surface tension, and contact angle with a nozzle surface (surface of the nozzle plate 401 on a Z-axis minus side) of the liquid material.

A cross-sectional shape of the nozzle hole 200 is illustrated as a tapered shape in FIG. 5, and alternatively the cross-sectional shape of the nozzle hole 200 may be, for example, a straight shape, a funnel shape, and a stepped shape.

Here, as shown in (B) of FIG. 5, the nozzle hole 200 is preferably provided at a position closer to a liquid material recovery flow path 319 side than to the liquid material supply flow path 318. In other words, the nozzle hole 200 is provided closer to the liquid material recovery flow path 319 side than to a center of the piezoelectric element 230. This is because the pressure of the liquid material which is increased by being applied to the pressure chamber 210 along with the flow of the supply and recovery of the liquid material (that is, the flow of the liquid material in the discharge flow path) can also be efficiently used as discharge energy. With such a configuration, a liquid material having a higher viscosity can be discharged with high accuracy.

<Pressure Chamber 210>

The pressure chamber 210 is a part of the discharge flow path, obtained by the orifice structure 402 dividing the discharge flow path. More specifically, the pressure chamber 210 is formed between the orifice structures 402 disposed at two positions in the flow direction of the liquid material in the discharge flow path. The pressure chamber 210 is a place for a series of operations of the inkjet head 105, such as reception of mechanical energy from the diaphragm 212 and due to the displacement of the piezoelectric element 230 and discharge of the liquid material from the nozzle hole 200 formed in the nozzle plate 401.

Specifically, the pressure chamber 210 stores the liquid material supplied from the liquid material supply flow path 318. Thereafter, in the pressure chamber 210, the pressure wave generated due to the mechanical energy transmitted from the diaphragm 212 is reflected by the pressure wall 211, the orifice structure 402, or the like, and is used as the discharge energy of the liquid material, so as to discharge the liquid material. Further, the pressure chamber functions as a branch point for switching between a state of discharging a portion of the stored liquid material from the nozzle hole 200 and a state of discharging a portion of the stored liquid material to the liquid material recovery flow path 319 for recovery.

Here, the nozzle plate 401, and the pressure wall 211 extending in the Z-axis direction from the diaphragm 212 are each a part of a sidewall forming the pressure chamber 210. The pressure wall 211 may be made of a metal material including, for example, stainless steel, nickel, cobalt, and palladium, or may be made of a resin material such as silicon resin, ceramic resin, PEEK or PI. The pressure wall 211 may be made of any material as long as the pressure wall 211 has a material and structure that is not damaged by the discharge pressure (pressure wave) when the liquid material is discharged or that is not eroded/eluted by the liquid material.

<Orifice Structure 402>

The pressure chamber 210 is a divided part of the discharge flow path. Specifically, the pressure chamber 210 is formed by the orifice structure 402 dividing the discharge flow path.

For example, in a case of handing a liquid material having a high viscosity of 0.01 Pa·s to 50 Pa·s, it is necessary to apply a higher pressure to the liquid material in the pressure chamber 210. Therefore, in the discharge flow path of the inkjet head 105, the orifice structures 402 are respectively disposed between the liquid material supply flow path 318 communicating with the pressure chamber 210 and the pressure chamber 210, and between the liquid material recovery flow path 319 communicating with the pressure chamber 210 and the pressure chamber 210. It is desirable that such an orifice structure 402 has a shape narrower than that of the pressure chamber 210 in a plan view as viewed from the discharge direction (Z-axis direction) of the liquid material.

More specifically, the orifice structure 402 is a structure in a columnar shape, a plate shape or other shapes, and protrudes from the pressure walls 211 on two sides in the X-axis direction in each of the discharge flow paths, when viewed from the Y-axis direction as shown in (A) of FIG. 5, and forms an opening to narrow a width of the discharge flow path. As shown in (B) of FIG. 5, the orifice structures 402 are respectively formed on a liquid material supply flow path 318 side and the liquid material recovery flow path 319 side of the pressure chamber 210.

With such an orifice structure 402, the pressure wave generated by the vibration of the diaphragm 212 can be confined in the pressure chamber 210. That is, since the pressure wave generated in the pressure chamber 210 can be made less likely to flow out to the liquid material supply flow path 318 or to the liquid material recovery flow path 319, the pressure applied to the liquid material in the pressure chamber 210 is increased. Further, since the pressure loss to the liquid material supply flow path 318 and the liquid material recovery flow path 319 is reduced, interaction due to the pressure propagating to the adjacent pressure chamber 210 via the liquid material common supply flow path 316 and the liquid material common recovery flow path 317 can also be prevented.

The orifice structure 402 may be made of a metal material including, for example, stainless steel, nickel, cobalt, and palladium, or may be made of a resin material such as silicon resin, ceramic resin, PEEK or PI. The orifice structure 402 may be made of any material as long as the orifice structure 402 has a material and structure that is not damaged by the discharge pressure (pressure wave) when the liquid material is discharged or that is not eroded/eluted by the liquid material. In addition, the orifice structure 402 may be formed integrally with the pressure wall or may be formed as an individual member.

In addition, in order to prevent air bubbles from being mixed into the liquid material when the liquid material is supplied to the pressure chamber 210, it is desirable to configure the orifice structure 402 in such a shape that a stagnation location where the liquid material stagnates is minimized. For this reason, it is desirable to minimize the location where a flow speed of the liquid material is significantly reduced due to, for example, a sharp bending structure or a sudden change in the cross-sectional shape of the flow path.

<Pressure Wave Reflection Wall 213>

The pressure wave reflection wall 213 efficiently propagates a pressure wave, which is generated by applying the pressure to the liquid material in the pressure chamber 210, to the nozzle hole 200 accompanying the reciprocating vibration of the diaphragm 212. Thus, the pressure wave reflection wall 213 is in contact with a displacement portion of the diaphragm 212 (that is, a location corresponding to the pressure chamber 210) and is provided at an outer edge portion of the pressure chamber 210.

The pressure wave reflection wall 213 is a plate-shaped member, and is disposed, for example, in contact with an end portion of the orifice structure 402 on the Z-axis plus direction side. In this configuration, the pressure wave reflection wall 213 is disposed for each of two orifice structures 402.

Further, it is preferable to dispose the pressure wave reflection wall 213 at a position closer to the nozzle hole 200 than the orifice structure 402. In other words, in a plan view as viewed from the Z-axis direction, the orifice structure 402 is disposed at a position farther from the nozzle hole 200 than the pressure wave reflection wall 213.

The pressure wave reflection wall 213 may be configured, for example, by extending the plate-shaped member toward a center side of the diaphragm 212 in the Y-axis direction. Accordingly, as indicated by small arrows in (A) of FIGS. 5 and (B) of FIG. 5, the directivity of a propagation direction of the pressure wave, which is generated by the reciprocating vibration of the diaphragm 212, toward a direction of the nozzle hole 200 can be improved. Therefore, even in a configuration in which the orifice structure 402 having a relatively low flow path resistance (little pressure loss) of the discharge flow path is used, the propagation of the pressure applied to the liquid material in the pressure chamber 210 to the liquid material supply flow path 318 and the liquid material recovery flow path 319 can be prevented, and as a result, a high pressure can be applied to the liquid material.

The pressure wave reflection wall 213 may be made of a metal material including, for example, stainless steel, nickel, cobalt, and palladium, or may be made of a resin material such as silicon resin, ceramic resin, PEEK or PI. The pressure wave reflection wall 213 may be made of any material as long as the pressure wave reflection wall 213 has a material and structure that is not damaged by the discharge pressure (pressure wave) when the liquid material is discharged or that is not eroded/eluted by the liquid material.

<Liquid Material Supply Flow Path 318 and Liquid Material Recovery Flow Path 319>

The liquid material supply flow path 318 is an example of a supply flow path that communicates with the pressure chamber 210 and has a function of supplying the liquid material to the pressure chamber 210. The liquid material recovery flow path 319 is an example of a recovery flow path that communicates with the pressure chamber 210 and has a function of recovering the liquid material from the pressure chamber 210.

The liquid material supply flow path 318 and the liquid material recovery flow path 319 are portions of the discharge flow path excluding the pressure chamber 210 which are divided by the orifice structures 402 at two positions. More specifically, divided spaces in an order of the liquid material supply flow path 318, the pressure chamber 210, and the liquid material recovery flow path 319 are provided along the flow direction of the liquid material in the discharge flow path. The orifice structures 402 are disposed between the divided spaces.

Since the liquid material supply flow path 318 and the liquid material recovery flow path 319 are formed on the discharge flow path, which is defined by the pressure wall 211 and the nozzle plate 401, similarly to the pressure chamber 210, the liquid material supply flow path 318 and the liquid material recovery flow path 319 are made of materials same as that of the pressure chamber.

The flow path cross-sectional area of the liquid material supply flow path 318 and the liquid material recovery flow path 319 is preferably selected from a range of 0.005 $mm^2$ to 1 $mm^2$, and flow path cross-sectional shapes thereof may be any shape such as a circular shape or a rectangular shape.

<Liquid Material Common Supply Flow Path 316 and Liquid Material Common Recovery Flow Path 317>

The liquid material common supply flow path 316 has a function of supplying the liquid material to the liquid material supply flow paths 318 of each of the plurality of discharge flow paths. The liquid material common supply flow path 316 may be made of, for example, a material same as those of the nozzle plate 401 and the pressure wall 211. The liquid material common supply flow path 316 is in a pipe shape having an opening communicating with the liquid material supply flow paths 318 of the plurality of discharge flow paths, and a cross-sectional shape thereof is not particularly limited.

The liquid material common recovery flow path 317 has a function of recovering the liquid material from the liquid material recovery flow paths 319 of each of the plurality of discharge flow paths. The liquid material common recovery flow path 317 may be made of, for example, a material same as those of the nozzle plate 401 and the pressure wall 211. The liquid material common recovery flow path 317 is in a pipe shape having an opening communicating with the liquid material recovery flow paths 319 of the plurality of discharge flow paths, and a cross-sectional shape thereof is not particularly limited.

The liquid material common supply flow path 316 and the liquid material common recovery flow path 317 are in communication with a liquid material supply tank to be described below, and have a function of supplying the liquid material filled in the liquid material supply tank to the nozzle hole 200 and recovering the liquid material to the liquid material supply tank.

Materials same as those of the pressure chamber 210 and the nozzle hole 200 can be used for the liquid material common supply flow path 316 and the liquid material common recovery flow path 317. The flow path cross-sectional area thereof is preferably selected from a range of 0.1 $mm^2$ to 20 $mm^2$, and the flow path cross-sectional shape thereof may be any shape such as a circular shape or a rectangular shape.

<Inkjet Coating Device>

Figure 6:
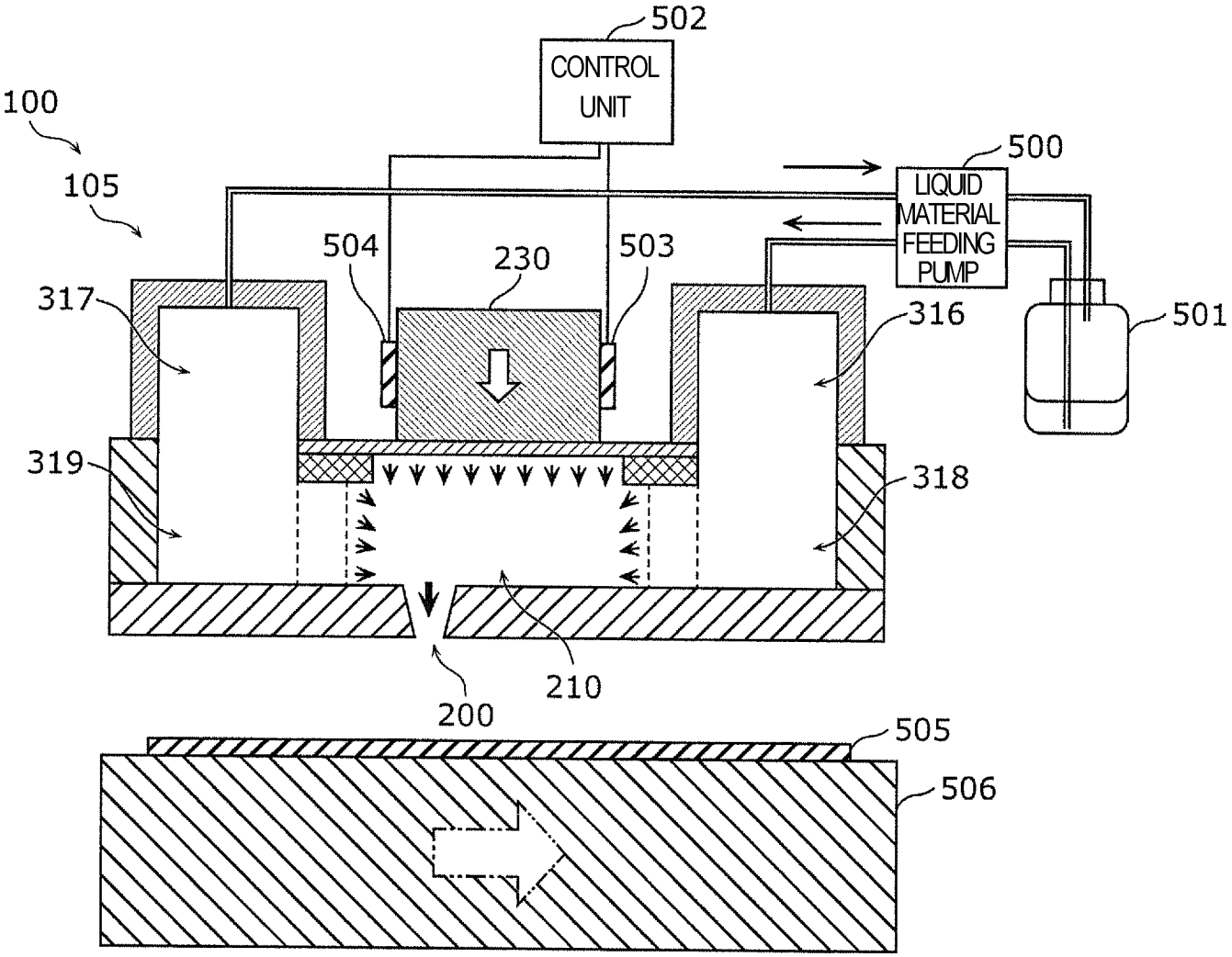
FIG. 6 is a schematic view illustrating connection relationships and device functions of the inkjet coating device according to the embodiment.

Next, the inkjet coating device 100 including the inkjet head 105 will be described with reference to FIG. 6. FIG. 6 is a schematic view illustrating connection relationships and device functions of the inkjet coating device 100.

The inkjet coating device 100 according to the present embodiment includes the inkjet head 105, a liquid material supply unit, a control unit 502, and a transport unit 506.

The liquid material supply unit is a device that supplies the liquid material to the inkjet head 105, and is implemented by, for example, a pump. Here, the liquid material supply unit will be described as a liquid material feeding pump 500. The liquid material feeding pump 500 is disposed on a flow path connecting a liquid material supply tank 501 and the liquid material common supply flow path 316, and continuously transfers the liquid material from the liquid material supply tank 501 to the liquid material common supply flow path 316. In addition, the liquid material feeding pump 500 is also disposed on a flow path connecting the liquid material supply tank 501 and the liquid material common recovery flow path 317, and continuously transfers the liquid material from the liquid material common recovery flow path 317 to the liquid material supply tank 501. By such transfer, the liquid material is always circulated between the liquid material supply tank 501 and the discharge flow path of the inkjet head 105.

The liquid material feeding pump 500 may be a plurality of pumps provided on the liquid material common supply flow path 316 and the liquid material common recovery flow path 317, or may be a single pump that performs the liquid feeding in an overall manner. Although the liquid material supply tank 501 is also shown to serve as a recovery tank for storing the recovered liquid material, if the recovered liquid material is not to be reused, the liquid material supply tank 501 and the recovery tank may be provided separately.

The control unit 502 is a device that generates an electrical signal for driving the actuator (the piezoelectric element 230), and is configured with, for example, a power supply device for applying a pulsed drive voltage, and a control device for controlling voltage application, such as a microcomputer or a processor.

The control unit 502 displaces the piezoelectric element 230 by applying a drive voltage to terminal electrodes 503 and 504 that are connected to the internal electrode of the piezoelectric element 230 described above. When the application of the drive voltage is released, the piezoelectric element 230 returns to an original shape. The control unit 502 controls an operation of discharging the liquid material from the nozzle hole 200 by applying the pulsed drive voltage, for repeatedly shifting the piezoelectric element 230 between the displaced state and the original state, to the piezoelectric element 230 at a timing when the liquid material is desired to be discharged.

The transport unit 506 is a device that moves a coating target 505 and the inkjet head 105 relative to each other, and specifically is a stage or the like that is movable. The inkjet head 105 may be movable with respect to a placement table on which the coating target 505 is placed.

The transport unit 506 is, for example, a placement table on which the coating target 505 is placed, and moves the coating target 505 relative to the inkjet head 105, for example, in a direction indicated by a white arrow of two-dot chain line in the drawing. The transport unit 506 changes the positions of the inkjet head 105 and the coating target 505 interlockingly with the operation of discharging the liquid material by the inkjet head 105 through such a relative movement, such that an area to be coated of the coating target 505 is directly below the nozzle hole 200.

<Coating Operation>

Figure 7:
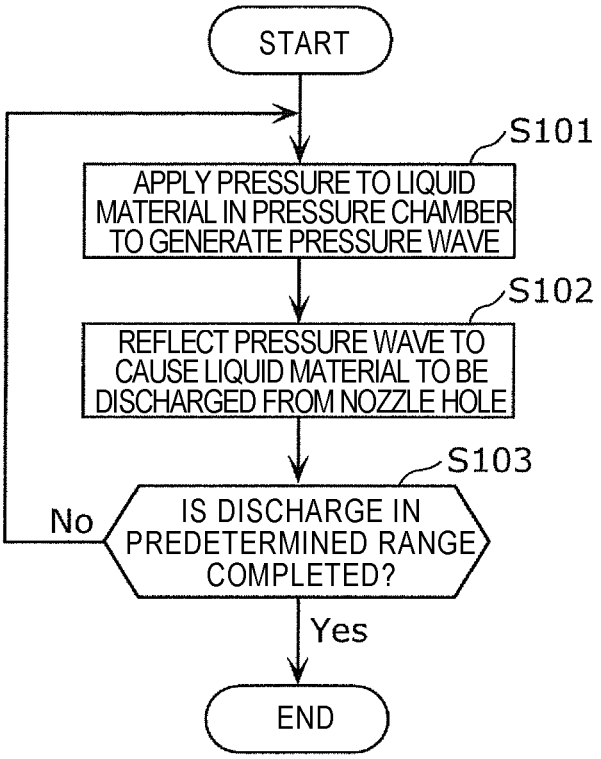
FIG. 7 is a flowchart illustrating an operation of performing coating with a liquid material using the inkjet coating device according to the embodiment.

Next, an operation of coating with the liquid material by the inkjet coating device 100 will be described below with reference to FIG. 7. FIG. 7 is a flowchart illustrating the operation of coating with the liquid material using the inkjet coating device 100.

A pressure difference is generated between the liquid material common supply flow path 316 and the liquid material common recovery flow path 317 due to pressures of suction and discharge of the liquid material feeding pump 500. Accordingly, the liquid material can be supplied to the entire discharge flow path including the pressure chamber 210 and the vicinity of the nozzle hole 200, and further the liquid material can be recovered.

As such a pressure difference increases, the supply speed of and the recovery speed of the liquid material are increased, whereas when a liquid material having a high viscosity is used, a pressure gradient in the liquid material common supply flow path 316 and the liquid material common recovery flow path 317 is increased. At this time, since variation in a back pressure in the nozzle hole 200 of the discharge flow paths is increased and a liquid surface position (a liquid surface position in the Z-axis direction) in the nozzle hole 200 may become non-uniform, the pressure difference is preferably about 100 kPa or less.

Further, even in a case where the pressure difference is 100 kPa or less, when the liquid material seeps out from the nozzle hole 200, a meniscus surface of a gas-liquid interface is unstabilized and stabilized droplet discharge cannot be performed. Therefore, it is essential to set the pressure difference in accordance with the liquid material and a discharge condition.

Here, the orifice structure 402 is provided in each of the discharge flow paths. The orifice structure 402 is in a shape that is narrower than the pressure chamber 210 in a plan view as viewed from the discharge direction of the liquid material, as described above, and that is narrower than the liquid material supply flow path 318. It is the same in the liquid material recovery flow path 319. The orifice structure 402 is formed only at a location corresponding to a predetermined thickness (a length in the Y-axis direction) in the discharge flow path, and does not narrow the flow paths at other locations.

A thickness of such an orifice structure 402 is sufficiently smaller than a length of the discharge flow path in the flow direction of the liquid material. Thus, a liquid material having a high viscosity is not inhibited by what can be a barrier before passing through the liquid material supply flow path 318 (passing through the opening of the orifice structure 402). Therefore, a configuration that may inhibit the flow of the liquid material, such as a location where a flow path diameter is reduced, can be eliminated from the flow path of the liquid material as much as possible before passing through the orifice structure 402, and thus a supply system of the liquid material which has a little pressure loss can be designed.

After the liquid material is filled in the entire discharge flow path as described above, the control unit 502 performs control of discharging the liquid material. Specifically, the diaphragm 212 vibrates accompanying the displacement of the piezoelectric element 230 due to the application of the pulsed drive voltage generated by the control unit 502. Accordingly, the volume of the pressure chamber is reduced, and a pressure wave is generated in the liquid material in the vicinity of the diaphragm 212 (step S101). Further, the generated pressure wave propagates and the liquid material is discharged from the nozzle hole 200 (step S102).

The generation of the pressure wave and the discharge of the liquid material (step S101 and step S102) are repeated over an entire area (a predetermined range) to be coated of the coating target 505 (step S103), and the operation of coating with the liquid material in the predetermined range is completed.

More specifically, when the diaphragm 212 vibrates (downward) toward the nozzle hole 200, the pressure wave is generated, and the propagating pressure wave is reflected by the pressure wall 211, the pressure wave reflection wall 213, and the orifice structure 402. In this way, the pressure wave that has reached the nozzle hole 200 increases the pressure of the liquid material in the vicinity of the nozzle hole 200, and causes the liquid material to be discharged as discharge liquid droplets.

Since the pressure of the liquid material in the vicinity of the nozzle hole 200 can be rapidly increased as a vibration speed of the diaphragm 212 in a downward direction increases, a discharge speed of the leading liquid material flying out of the nozzle hole 200 can be increased. Further, by operating the diaphragm 212 quickly in an upward direction after the leading liquid material starts to fly out of the nozzle hole 200, it is possible to reduce the discharge speed of the subsequent liquid material. Accordingly, even when a liquid material having a high viscosity is used, it is possible to shorten the stringing of the discharge liquid droplets, and it is possible to discharge the liquid material more accurately and stably in a trace amount of discharge liquid droplets. That is, a discharge accuracy of the liquid material can also be improved by a design of the pulsed drive voltage for controlling the displacement of the piezoelectric element 230.

As described above, the inkjet head 105 according to the present embodiment includes: the nozzle hole 200 through which the liquid material is discharged; the pressure chamber 210 that communicates with the nozzle hole 200; the liquid material supply flow path 318 (supply flow path) that communicates with the pressure chamber 210 and through which the liquid material is supplied to the pressure chamber 210; the liquid material recovery flow path 319 (recovery flow path) that communicates with the pressure chamber 210 and through which the liquid material is recovered from the pressure chamber 210; the diaphragm 212 that reciprocally vibrates with respect to the liquid material supplied into the pressure chamber 210; the piezoelectric element 230 (actuator) that provides a displacement for vibrating the diaphragm 212; and the orifice structures 402 that are respectively disposed between the liquid material supply flow path 318 and the pressure chamber 210, and between the liquid material recovery flow path 319 and the pressure chamber 210, and that are narrower than the pressure chamber 210 in a plan view as viewed from the Z-axis direction (discharge direction of the liquid material).

With such a configuration, the pressure wave generated by the vibration of the diaphragm 212 is confined in the pressure chamber 210. Therefore, the pressure loss is little, and the pressure required for discharging the liquid material can be efficiently applied.

For example, the inkjet head 105 may further include the pressure wave reflection wall 213 that is in contact with the diaphragm 212 and that is provided at the outer edge portion of the pressure chamber 210.

Accordingly, the generated pressure wave can be reflected by the pressure wave reflection wall 213, and the pressure required for discharging the liquid material can be efficiently applied.

Further, for example, in the inkjet head 105, the orifice structure 402 may be disposed at a position farther from the nozzle hole 200 than the pressure wave reflection wall 213 in a plan view as viewed from the Z-axis direction.

Accordingly, since the generated pressure wave can be reflected by the pressure wave reflection wall 213 and the pressure wave directed to the opening of the orifice structure 402 can be further reduced, the pressure required for discharging the liquid material can be efficiently applied.

Further, for example, the nozzle hole 200 of the inkjet head 105 may be provided at a position closer to the liquid material recovery flow path 319 side than to the liquid material supply flow path 318.

Accordingly, since the pressure required for discharging the liquid material is obtained by utilizing the flow of the liquid material flowing through the discharge flow path, the pressure required for discharging the liquid material can be efficiently applied.

Further, for example, the actuator for causing the inkjet head 105 to discharge the liquid material may be configured using the piezoelectric element 230.

Accordingly, the discharge of the liquid material can be controlled only by the application of the drive voltage and the release of the drive voltage, and the application of the pressure required for discharging the liquid material can be easily controlled.

Further, the inkjet coating device 100 according to the present embodiment includes: the inkjet head 105; the liquid material feeding pump 500 (liquid material supply unit) that supplies the liquid material to the inkjet head 105; the control unit 502 that generates the electrical signal for driving the piezoelectric element 230 (actuator), and that controls the operation of discharging the liquid material by the inkjet head 105; and the transport unit 506 that moves the inkjet head 105 and the coating target 505 relative to each other.

Accordingly, it is possible to continuously coat the coating target 505, which is moved by the transport unit 506, with the liquid material to which the pressure required for discharging the liquid material is efficiently applied.

Further, an inkjet coating method according to the present embodiment includes: a generating step of generating a pressure wave by reducing a volume of the pressure chamber 210 in which a liquid material supplied from a supply flow path is accommodated; and a discharging step of discharging the liquid material from the nozzle hole 200, by reflecting the generated pressure wave in a direction of the nozzle hole 200 through the pressure wave reflection wall 213 provided in the pressure chamber 210 and through orifice structures 402 that are respectively disposed between the liquid material supply flow path 318 and the pressure chamber 210, and between the liquid material recovery flow path 319 and the pressure chamber 210.

Accordingly, the pressure wave generated in the pressure chamber 210 is reflected and confined in the pressure chamber 210. Therefore, the pressure loss is little, and the pressure required for discharging the liquid material can be efficiently applied.

<First Modification>

Hereinafter, a modification of the embodiment of the disclosure will be described. Since the first modification is mainly different from that of the embodiment described above in the shape of the orifice structure, the orifice structure will be mainly described, and descriptions of other substantially equivalent structures will be omitted or simplified.

<Modification of Orifice Structure 402>

Figure 8:
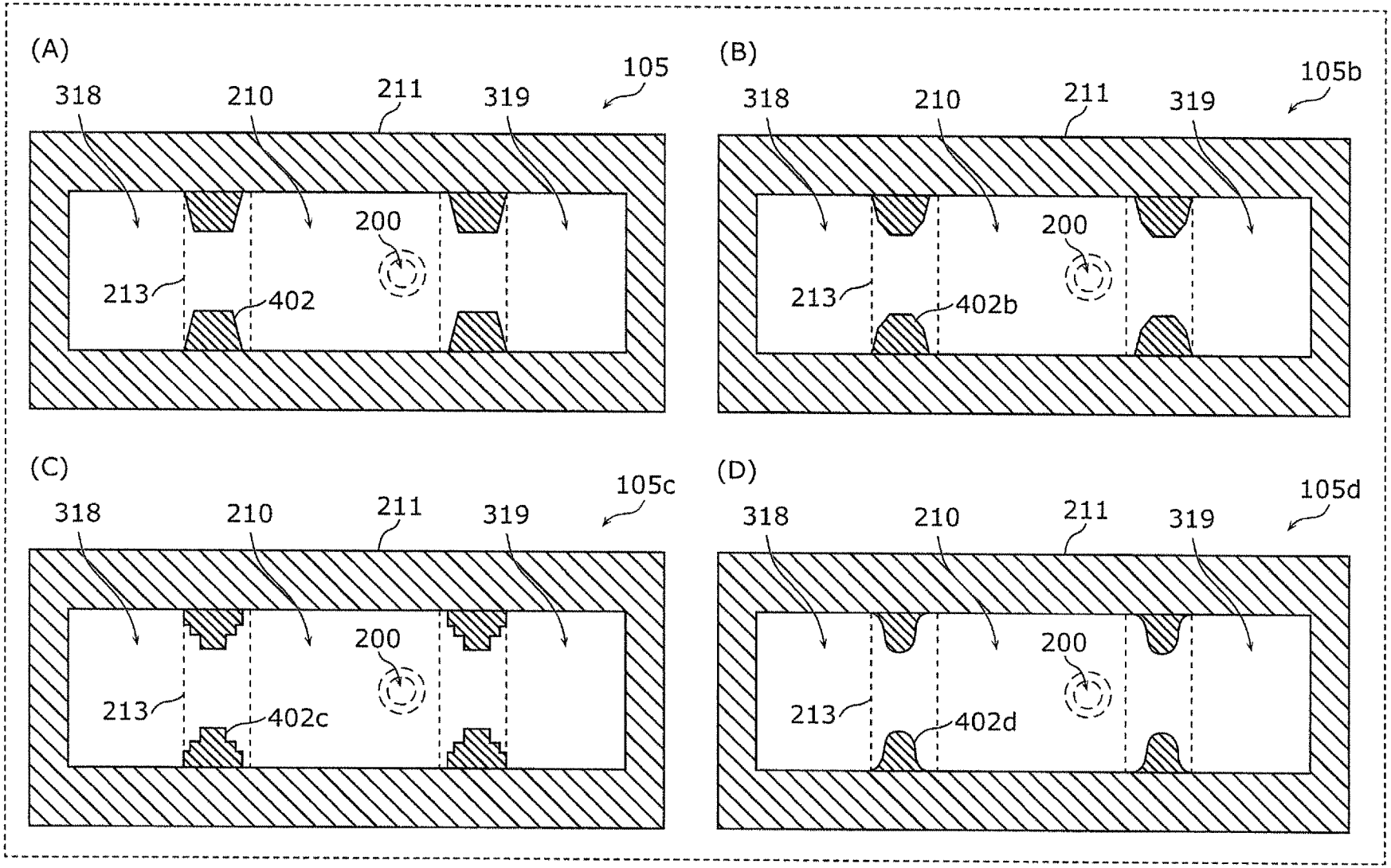
FIG. 8 is a diagram illustrating an inkjet head according to a first modification.

The first modification will be described below with reference to FIG. 8. FIG. 8 is a diagram illustrating an inkjet head according to the first modification. FIG. 8 is a cross-sectional view of one discharge flow path viewed from the same viewpoint as in FIG. 4, and shows discharge flow paths of three examples according to the modification and one discharge flow path according to the embodiment described above for comparison.

(A) of FIG. 8 shows a basic configuration (comparative example) same as that of the embodiment described above. In contrast, as shown in (B) of FIG. 8, in an orifice structure 402*b* according to a first example of the first modification, a configuration of a location where a flow path resistance changes is configured with a stepwise inclined flow-guiding part (an example of a first flow-guiding part) having a stepwise inclination. The stepwise inclined flow-guiding part guides the liquid material to an opening of the orifice structure 402*b* in a direction from the liquid material supply flow path 318 toward the liquid material recovery flow path 319. Accordingly, a corner relatively close to a right angle where bubbles and stagnation are likely to occur can be eliminated, and the flow of the liquid material can be made smooth.

As shown in (C) of FIG. 8, an orifice structure 402*c* in a second example of the first modification includes a stepwise flow-guiding part (an example of the first flow-guiding part) in which a flow path width changes stepwise. Accordingly, the liquid material flowing through the discharge flow path can be gradually guided to an opening of the orifice structure 402*c*, and the flow of the liquid material can be made smooth.

Further, as shown in (D) of FIG. 8, an orifice structure 402*d* in a third example of the first modification includes a streamlined flow-guiding part (an example of the first flow-guiding part) that has a smooth streamline shape. Accordingly, there is no corner where bubbles and stagnation are likely to occur, and the flow of the liquid material can be made smooth.

It should be noted that the first flow-guiding parts shown in the three examples described above may be formed in one of the orifice structures 402 formed at two positions in the discharge flow paths. The first flow-guiding parts are formed in line symmetry facing both the pressure chamber 210 and the liquid material supply flow path 318 in FIG. 8. Alternatively, the first flow-guiding part may be formed only on an upstream side (liquid material supply flow path 318 side). It is the same for the orifice structure 402 between the pressure chamber 210 and the liquid material recovery flow path 319.

As described above, the orifice structure of the inkjet head according to the first modification of the embodiment includes the first flow-guiding part that guides the liquid material to the opening of the orifice structure in the direction from the liquid material supply flow path 318 to the liquid material recovery flow path 319.

With such a configuration, the flow of the liquid material from the liquid material supply flow path 318 to the pressure chamber 210 and the liquid material recovery flow path 319 is smooth, and generation of bubbles or stagnation, which is one of main factors of discharge failure, can be prevented.

<Second Modification>

Hereinafter, a second modification will be described. Since the second modification is mainly different from that of the embodiment described above in the shape of the pressure chamber, the pressure chamber will be mainly described, and descriptions of other substantially equivalent structures will be omitted or simplified.

<Modification of Pressure Chamber 210>

Figure 9:
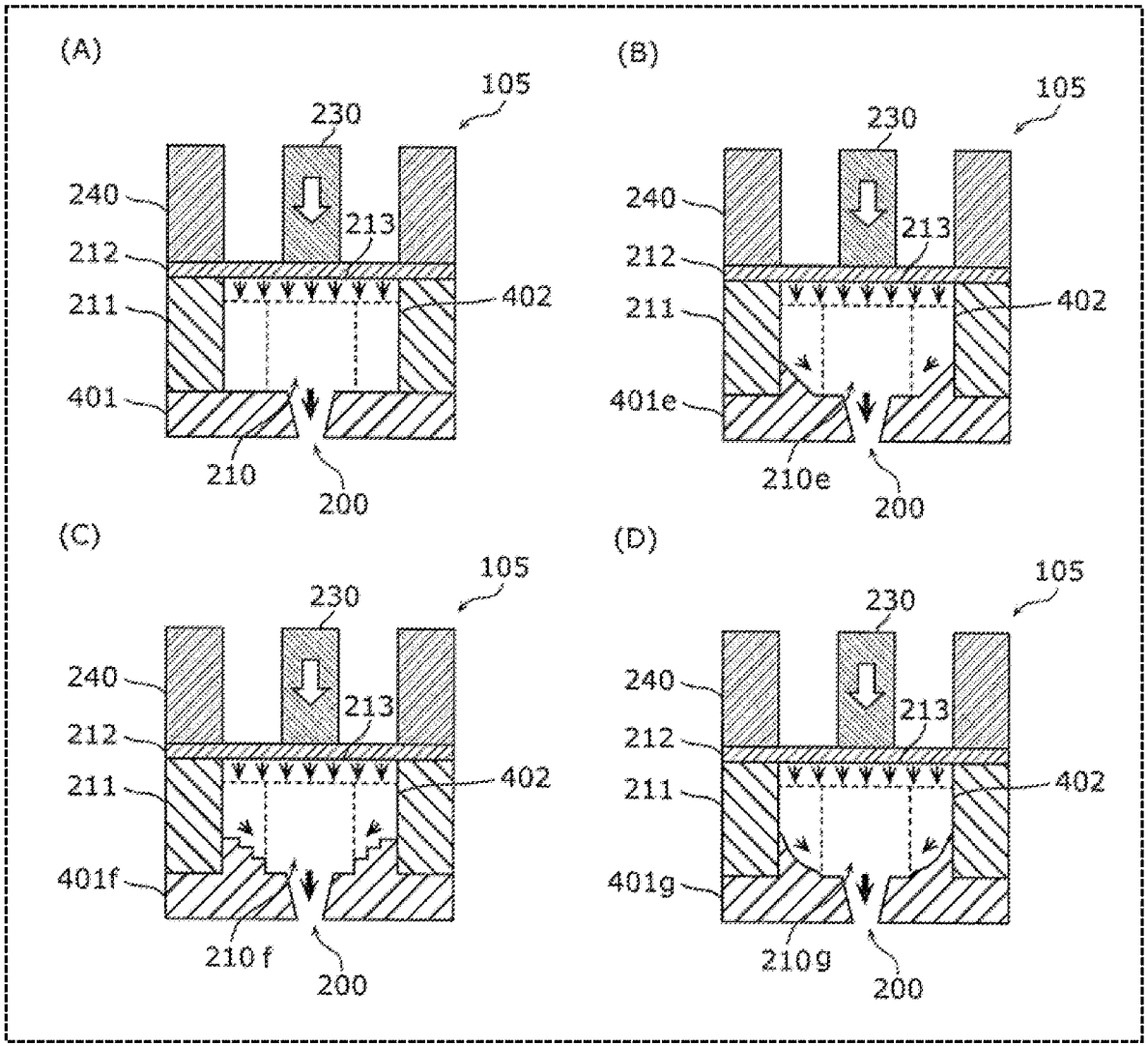
FIG. 9 is a diagram illustrating an inkjet head according to a second modification.

The second modification will be described below with reference to FIG. 9. FIG. 9 is a diagram illustrating an inkjet head according to the second modification. FIG. 9 is a cross-sectional view of one discharge flow path viewed from the same viewpoint as in (A) of FIG. 5, and shows discharge flow paths of three examples according to the modification and one discharge flow path according to the embodiment described above for comparison.

(A) of FIG. 9 is a basic configuration (comparative example) same as that of the embodiment described above. In contrast, as shown in (B) of FIG. 9, in a first example of the second modification, a pressure chamber 210*e* is configured such that a cross section of the pressure chamber 210*e* is stepwisely inclined while approaching a nozzle plate 401*e* from the diaphragm 212, as viewed from the flow direction (Y-axis direction) of the liquid material in the discharge flow path. More specifically, the nozzle plate 401*e* is disposed such that the nozzle hole 200 is sandwiched from two sides in the X-axis direction by a surface of the nozzle plate 401*e* on a Z-axis plus side (a pressure chamber 210*e* side), and has a stepwise inclined surface (an example of a second flow-guiding part) that guides the liquid material toward the nozzle hole 200. Accordingly, since the pressure wave propagating through the liquid material can be aggregated toward the nozzle hole 200, the applied pressure can be efficiently utilized for discharging the liquid material.

Further, as shown in (C) of FIG. 9, in a second example of the second modification, a pressure chamber 210*f* is configured in a stepwise shape in which a width of a cross section of the pressure chamber 210*f* stepwisely decreases while approaching a nozzle plate 401*f* from the diaphragm 212 as viewed from the Y-axis direction. More specifically, the nozzle plate 401*f* is disposed such that the nozzle hole 200 is sandwiched from two sides in the X-axis direction by a surface of the nozzle plate 401*f* on the Z-axis plus side, and has a stepwise surface (an example of the second flow-guiding part) that guides the liquid material toward the nozzle hole 200. Accordingly, since the pressure wave propagating through the liquid material can be aggregated toward the nozzle hole 200, the applied pressure can be efficiently utilized for discharging the liquid material.

Further, as shown in (D) of FIG. 9, in a third example of the second modification, a pressure chamber 210*g* is configured in a streamlined shape in which a width of a cross section of the pressure chamber 210*g* is smoothly narrowed while approaching the nozzle plate 401*g* from the diaphragm 212 as viewed from the Y-axis direction. More specifically, the nozzle plate 401*g* is disposed such that the nozzle hole 200 is sandwiched from two sides in the X-axis direction by a surface of the nozzle plate 401*g* on the Z-axis plus side, and has a streamlined surface (an example of the second flow-guiding part) that guides the liquid material toward the nozzle hole 200. Accordingly, since the pressure wave propagating through the liquid material can be aggregated toward the nozzle hole 200, the applied pressure can be efficiently utilized for discharging the liquid material.

It should be noted that the second flow-guiding part is described as part of the nozzle plate in the three examples described above, and alternatively the second flow-guiding part may be provided on the pressure wall 211, or may be configured as a member separate from the nozzle plate and the pressure wall.

As described above, the pressure chamber of the inkjet head according to the second modification of the embodiment further includes the second flow-guiding part, which is disposed on two sides sandwiching the nozzle hole 200 in a direction (that is, the X-axis direction) perpendicular to a direction from the liquid material supply flow path 318 to the liquid material recovery flow path 319 in a plan view as viewed from the Z-axis direction, and which guides the liquid material toward the nozzle hole 200.

With such a configuration, the pressure wave of the liquid material caused by the vibration of the diaphragm 212 can be aggregated in the vicinity of the nozzle hole 200, and the liquid material can be efficiently discharged.

The inkjet heads according to the embodiment, the first modification, and the second modification, the inkjet coating device including the same, and the coating method enable the inkjet system to be applied to industrial applications such as electronic device manufacturing in which long-term continuous driving is essential.

Other Embodiments

Although the embodiments have been described above, the disclosure is not limited to the embodiments described above.

Further, although the constituent elements constituting the inkjet head have been exemplified in the embodiments described above, the respective functions of the constituent elements provided in the inkjet head may be distributed to a plurality of parts constituting the inkjet head.

In addition, forms obtained by subjecting the embodiments to various modifications conceived by those skilled in the art, or forms implemented by arbitrarily combining the constituent elements and functions in the embodiments without departing from the gist of the disclosure are within the scope of the disclosure.

For example, the orifice structure 402 is configured with two members sandwiching the opening in the X-axis direction, and alternatively, the orifice structure 402 may also be configured with a single member when including an opening at a plus side end or a minus side end in the X-axis direction.

Although the configuration provided with the pressure wave reflection wall 213 has been described above, the pressure wave reflection wall 213 may not be provided when a sufficient pressure wave reflection mechanism can be designed with the orifice structure 402 or the like.

Further, although it is disclosed that the position of the nozzle hole 200 is closer to the liquid material recovery flow path 319 than to the liquid material supply flow path 318, the disclosure is not limited thereto. When a sufficient pressure wave reflection mechanism can be designed with the orifice structure 402 or the like, the nozzle hole 200 may be provided in a central portion of the pressure chamber 210, which makes the design of the reflected wave easy.

With the inkjet head, the inkjet coating device including the same, and the inkjet coating method of the disclosure, coating with a liquid material having a high viscosity and containing functional particles can be controlled at a high speed and in a stable manner, and a necessary location can be coated with an optimum amount of the liquid material in an arbitrary pattern and in a non-contact manner at a high speed.

Therefore, the inkjet head for coating in an arbitrary pattern and the inkjet coating device including the same are preferably used for purposes of improving productivity in manufacturing of electronic devices of small quantity and many kinds, or in 3D coating of three-dimensional structures including an uneven surface or a curved surface.

What is claimed is:

1. An inkjet head, comprising:

a nozzle hole through which a liquid material is discharged;

a pressure chamber that communicates with the nozzle hole;

a supply flow path that communicates with the pressure chamber and supplies the liquid material to the pressure chamber;

a recovery flow path that communicates with the pressure chamber and recovers the liquid material from the pressure chamber;

a diaphragm that reciprocally vibrates with respect to the liquid material supplied into the pressure chamber;

an actuator that provides a displacement for vibrating the diaphragm; and orifice structures that are respectively disposed between the supply flow path and the pressure chamber, and between the recovery flow path and the pressure chamber, and that are narrower than the pressure chamber in a plan view from perpendicular to a discharge direction of the liquid material, wherein the supply flow path, the recovery flow path and the pressure chamber are located on a same plane in a horizontal direction, and the orifice structures are columnar bodies with respect to a horizontal linear flow passage connecting the supply flow path, the recovery flow path and the pressure chamber, and narrow the horizontal linear flow passage.

2. The inkjet head according to claim 1, further comprising:

a pressure wave reflection wall that is in contact with the diaphragm, is disposed at an outer edge portion of the pressure chamber, and is supported by at least one of the orifice structures.

3. The inkjet head according to claim 2, wherein in the plan view, the orifice structures are disposed at a position farther from the nozzle hole than the pressure wave reflection wall.

4. The inkjet head according to claim 2, wherein the pressure wave reflection wall is a wall for applying pressure to the liquid material and propagating the pressure to the nozzle hole.

5. The inkjet head according to claim 1, wherein the nozzle hole is provided at a position closer to the recovery flow path than to the supply flow path.

6. The inkjet head according to claim 1, wherein each of the orifice structures includes a first flow-guiding part that guides the liquid material to an opening of the orifice structure in a direction from the supply flow path to the recovery flow path.

7. The inkjet head according to claim 1, wherein a cross section of each of the columnar bodies in the horizontal direction has a trapezoidal shape.

8. The inkjet head according to claim 1, further comprising:

a common recovery flow path connecting a plurality of recovery flow paths including the recovery flow path; and a common supply flow path connecting a plurality of supply flow paths including the supply flow path.

9. The inkjet head according to claim 1, wherein the supply flow path, the recovery flow path and the pressure chamber are one rectangular parallelepiped space.

10. The inkjet head according to claim 1, wherein the columnar bodies are positioned at each of four corners of the pressure chamber.

* * * * *